United States Patent [19]

Loyd

[11] Patent Number: 4,853,049

[45] Date of Patent: Aug. 1, 1989

[54] NITRIDING GRADE ALLOY STEEL ARTICLE

[75] Inventor: Calvin D. Loyd, Peoria, Ill.

[73] Assignee: Caterpillar Inc., Peoria, Ill.

[21] Appl. No.: 203,601

[22] Filed: Jun. 3, 1988

Related U.S. Application Data

[63] Continuation of Ser. No. 52,143, May 4, 1987, abandoned, which is a continuation-in-part of Ser. No. 675,001, Feb. 13, 1984, abandoned.

[51] Int. Cl.[4] ..... C22C 38/24

[52] U.S. Cl. ..... 148/318; 148/333

[58] Field of Search ..... 148/318, 16.6, 317, 148/333; 420/127, 104

[56] References Cited

U.S. PATENT DOCUMENTS

| | | | |
|---|---|---|---|
| 1,835,151 | 12/1931 | Fry | 75/124 |
| 3,155,495 | 11/1964 | Nakamura | 75/124 |
| 3,600,161 | 8/1971 | Inouye et al. | 420/104 |
| 3,901,740 | 8/1975 | Anderson et al. | 148/31.5 |

FOREIGN PATENT DOCUMENTS

| | | | |
|---|---|---|---|
| 0078254 | 10/1982 | European Pat. Off. . | |
| 1184509 | 12/1964 | Fed. Rep. of Germany . | |
| 1421856 | 1/1965 | France . | |
| 53-113214 | 10/1978 | Japan | 148/318 |
| 55-152175 | 11/1980 | Japan | 148/16.6 |
| 55-161065 | 12/1980 | Japan | 148/318 |
| 58-171558 | 10/1983 | Japan | 148/318 |
| 810850 | 3/1981 | U.S.S.R. | 75/126 E |

*Primary Examiner*—deborah Yee

*Attorney, Agent, or Firm*—Robert A. McFall

[57] ABSTRACT

A through hardening nitriding grade alloy steel includes aluminum in a range of 0.07% to 0.20% by weight and vanadium in a range of 0.03% to 0.10% by weight.

Prior art nitriding grade alloy steel generally have relied on molybdenum, nickel and other expensive alloy additions to provide nitridability and core hardness. The present invention includes only essential amounts of carbon, manganese, and chromium, in addition to small, controlled amounts of aluminum and vanadium. The present invention is not only economical to produce due to the absence of significant amounts of costly alloying elements, but also has a unique combination of hardenability, resistance to loss of hardness during tempering, and excellent nitride response.

Articles manufactured from the new alloy steel are desirably hardened, tempered, machined and nitrided, and are useful in applications requiring high wear resistance, toughness, and high stress loading. Such articles include gears, shafts, bushings, couplings and other such articles subjected to severe service applications.

2 Claims, 3 Drawing Sheets

NITRIDING GRADE ALLOY STEEL ARTICLE

DESCRIPTION

This is a continuation of Ser. No. 052,143 filed May 4, 1987, now abandoned, which was a continuation-in-part of Ser. No. 675,001 filed Feb. 13, 1984, now abandoned.

1. Technical Field

This invention relates generally to an alloy steel and more particularly to a through hardening nitriding grade alloy steel and articles made therefrom.

2. Background Art

The nitrogen case hardening process which is termed "nitriding" consists of subjecting machined and heat-treated parts to the action of a nitrogenous medium, commonly ammonia gas, at a temperature of about 510° C. (950° F.) to 538° C. (1,000° F.). Nitriding increases surface hardness, wear resistance, and resistance to certain types of corrosion and surface stresses that improve the fatigue resistance of a nitrided part. Accordingly, nitrided alloy steel articles are often used for gears, couplings, shafts and other applications that require resistance to wear and high stress loading.

One group of alloy steels suitable for nitriding have a composition as follows:

| | |
|---|---|
| Carbon | 0.21–0.25% by weight |
| Manganese | 0.50–0.70% |
| Aluminum | 1.10–1.40% |
| Nickel | 3.25–3.75% |
| Chromium | 1.00–1.30% |
| Molybdenum | 0.20–0.30% |
| Silicon | 0.20–0.40 |
| Iron and acceptable trace elements | Balance |

A more economical group of hardenable alloy steels that have been nitrided after heat treating are the AISI/SAE 4100 series alloy steel. In particular, AISI/-SAE 4140H alloy steel has been found to be useful in the manufacture of various gears that require a combination of high surface hardness and core hardness. AISI/SAE 4140H alloy steel has a specified composition as follows:

| | |
|---|---|
| Carbon | 0.37–0.44 |
| Manganese | 0.65–1.10 |
| Silicon | 0.15–0.35 |
| Chromium | 0.75–1.20 |
| Molybedenum | 0.15–0.25 |
| Iron and acceptable trace elements | Balance |

Typically, parts having the above composition are first forged, or rolled from billets, and are quenched and tempered, then machined and nitrided. Although AISI/SAE 4140H alloy steel has been useful in certain nitriding applications, it also has some disadvantages. For example, this steel contains molybdenum, an expensive alloying element. Further, it has been found that articles having the AISI/SAE 4140H composition are prone to quench cracking and therefore generally require an oil quench. Still further, the nitrided case hardness of AISI/SAE 4140H is generally limited to about Rockwell C (Rc) 55 or less. An alloy steel composition for the manufacture of non-hardened parts by a process called nitempering is disclosed in Japanese patent Nos. 55 161 065 and 55 152 175. Both patents are directed at producing low-distortion steel parts such as gear sand other transmission components. Core hardness is achieved by alloy addition rather than by heat treatment. After machining from an as-rolled steel bar or forging, workpieces formed of the broadly described alloy are nitempered. Nitempering, also known in Japn as "soft nitriding", is faster than conventional nitriding and develops an extremely hard skin on steels and cast irons. In nitempering, parts are treated at 566° C. (1050° F.) for two to six hours in an atmosphere comprising equal parts of endogas (a reducing gas mixture such as carbon monoxide and hydrogen) and ammonia. The hard case that results contains a complex iron-carbon-nitrogen compound. By avoiding the heat treatment operation generally preceding conventional nitriding, distortion of the workpiece is reduced. However, the case produced is thinner than that obtained by nitriding, and the increase in toughness resulting from a pre-nitriding heat treatment of the workpiece is not obtained. Further, the increased cost of alloy additions to achieve a core hardness comparable to quenched and tempered steel is economically undesirable.

The present invention is directed to overcoming the problems set forth above. In particular, a through hardening alloy steel according to the present invention provides a composition that is economical, adaptable to a variety of quench mediums, maintains high core hardness after tempering and has improved nitriding characteristics. The initial cost of the steel is reduced due to the deletion of molybdenum or other strength-improving alloys. Within quite broad dimensional sizes, articles manufactured of the ally steel composition of the present invention may be quenched in either a water or oil medium. Further, after tempering, such articles retain a useful core hardness within a controlled range of from Rc 25 to Rc 32 depending upon tempering temperature. Also, it has been found that for equivalent case depths, nitriding time of articles having the new alloy composition may be decreased by as much as 40% compared to articles having the AISI/SAE 4140H composition.

DISCLOSURE OF THE INVENTION

In accordance with one aspect of the present invention a through hardening nitriding grade alloy steel has a composition, by weight percent, of 0.20 to 0.40 carbon, 0.50 to 1.60 manganese, 0.40 to 1.50 chromium, 0.07 to 0.30 aluminum, 0.03 to 0.20 vanadium, and 0.10 to 0.40 silicon with the balance being essentially iron.

In another aspect of the present invention, an article formed from an alloy steel having the above composition has a surface hardness, measured on the Rockwell 15-N scale, of at least 89 and a core hardness of at least Rockwell C 25 after the article has been quenched, tempered and nitrided.

The alloy steel composition according to the present invention provides a unique combination of hardenability, resistance to loss of hardness during tempering and greatly enhanced response to nitriding. These characteristics are achieved by the use of small, carefully controlled amounts of aluminum and vanadium. Further, the unique properties are achieved without the need for expensive nickel or molybdenum additions and hence provides an economical material.

BEST MODE FOR CARRYING OUT THE INVENTION

Figure 1:
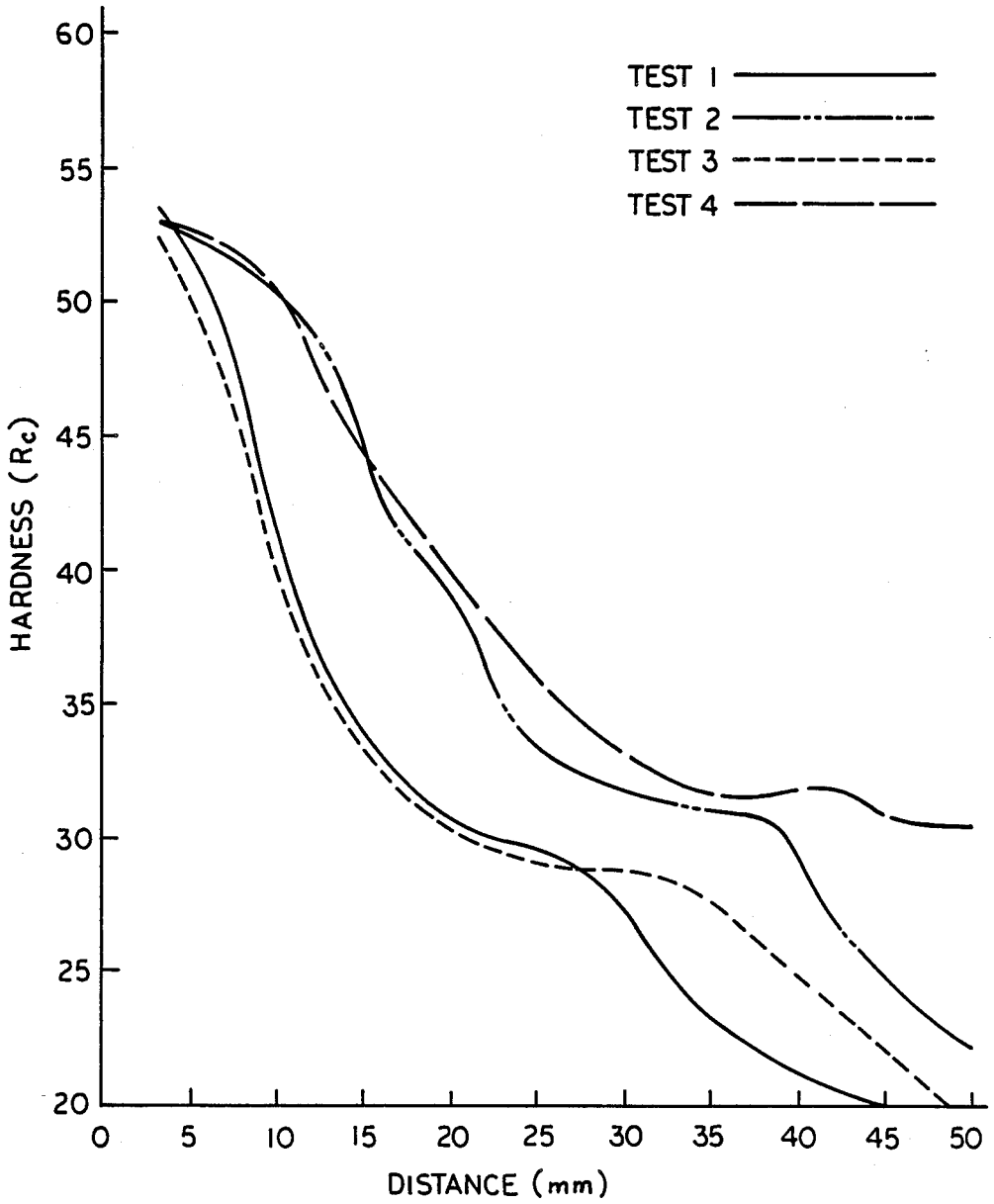
FIG. 1 is a graph illustrating the improved hardenability characteristics of a nitriding grade alloy steel according to the present invention.

Carbon contributes to the attainable hardness level as well as the depth of hardening. In accordance with the present invention, the carbon content is at least 0.20% by weight to maintain adequate core hardness after tempering and is no more than about 0.40% by weight to assure resistance to quench cracking and an adequate response to nitriding. It has been found that if the carbon content is more than about 0.34% by weight, water quenching may cause cracking or distortion in complex-shaped articles and, in such cases, a less drastic quench medium such as oil may be required. Therefore although a broad range of 0.20–0.40% carbon by weight is contemplated, a more desirable range is 0.24–0.34% carbon. Advantageously, alloy steel articles formed from the more desirable or preferred ranges described herein may be either water or oil quenched, whichever is more convenient.

Manganese contributes to the deep hardenability and is therefore present in all hardenable alloy steel grades. The disclosed alloy steel contains manganese in an amount of at least 0.50% to assure adequate core hardness and contains no more than about 1.60% to prevent cracking. In addition to the permissable broad range of 0.50% to 1.60% by weight, a narrower range of manganese from 1.00% to 1.30% is preferred to maintain uniformity of heat treat response.

Chromium contributes to the hardenability of the present steel alloy and is also an excellent nitride former thereby enhancing nitriding characteristics. To best realize these effects a minimum of 0.40% chromium is required, and preferably at least 0.90% chromium should be present. To avoid embrittlement, the amount of chromium should be limited to a maximum of 1.50%, and preferably no more than about 1.20%.

Aluminum, an essential ingredient of the present invention, contributes to hardenability and is a good nitrider former. As will be shown by examples, aluminum should be present in an amount of at least 0.07%, and preferably at least 0.10%. If aluminum is present in an amount less than about 0.07%, not only is there little observable improvement in either hardenability or nitride response but also, the benefits are very inconsistent. It has also been found that while aluminum in amounts greater than 0.30% are beneficial to nitrideability, the tendency for case embrittlement also increases. Accordingly, it is desirable to maintain an upper limit of no more than 0.30% aluminum and preferably no more than about 0.20%. It has been discovered that the present alloy steel having aluminum in the designated range, permits a wide range of quench practices and consistently improves hardenability.

Vanadium is also an essential ingredient in the present alloy steel composition, and must be present in an amount of at least 0.03% to realize a consistently measurable enhancement of case and core hardness. Vanadium, in amounts greater than 0.20% does not significantly enhance the nitride response or the hardenability of the material. For these reasons, the limits of vanadium are at least 0.03% and no more than 0.20%; and preferably from 0.05% to 0.10% to make the best economic use of this ingredient.

It has been found that the unique combination of aluminum and vanadium, within the specified ranges, greatly contributes to improved nitride response, thereby decreasing required nitriding time and increasing case hardness and depth. Further, the unique combination of aluminum and vanadium, within the specified ranges, contributes to hardenability and temper resistance.

The remainder of the alloy steel composition is essentially iron except for nonessential or residual amounts of elements which may be present in small amounts. For example silicon in the recognized commercially specified amounts is used for deoxidation of the molten steel. For this purpose silicon may be present in an amount of at least 0.10%. Sulphur, which in small amounts may be beneficial in that it promotes machining, is allowable in an amount of no more than about 0.10%, and preferably no more than 0.04% to avoid loss of ductility. Likewise, if desired, lead may be added in an amount up to about 0.15% to improve free machining characteristics of the material. Phosphorus in an amount over 0.05% may cause embrittlement, and preferably the upper limit should not exceed 0.035%. Other elements generally regarded as incidental impurities may be present within commercially recognized allowable amounts.

Manufactured articles, such as shafts, couplings and gears, having the above stated composition, are preferably initially formed to a desired shape by forging or rolling. The formed articles are hardened by heating to a temperature of about 870° C. (1600° F.) for a period of about one hour and then quenched in either water or oil to complete transformation of the ferrite and pearlite microstructure to martensite. After tempering to precipitate and agglomerate the carbide particles and thereby provide improved toughness, the articles, if required, are then machined. to a desired final dimension and then nitrided. In the past, nitriding grade alloy steel compositions generally required oil quenching. The less restrictive requirement for the present material with respect to quench practice is a result of the contribution that aluminum makes to both nitrideability and hardenability, particularly in combination with the lower carbon limits of the preferred range. The increased freedom to select quench medium is therefore a valuable benefit of the present invention.

EXAMPLE 1

The marked influence of aluminum, and in particular the combined benefit of both aluminum and vanadium, in providing increased hardness is shown below in Table I and illustrated graphically in FIG. 1. The test samples were all made from the same base heat and have substantially identical measured amounts of carbon, manganese, chromium and silicon, all of which are within the above described required ranges. Varying amounts of aluminum and vanadium were added during four taps of the base heat. The product of these taps was rolled into 32 mm (1.25 inch) squares before Jominy bars and nitriding specimens were obtained. Test samples 1 and 3 contain relatively low amounts of aluminum, and test samples 2 and 4 contain aluminum in an amount close to the upper end of the preferred range. Vanadium, in an amount representing the lower end of the preferred range, was added to test samples 3 and 4. The test samples were heated and quenched in accordance with the standard ASTM End Quench Test for Hardenability of Steel (A255) and the following hardness values were measured in 1/16 inch (1.59 mm) increments from the quenched ends.

TABLE I

| Measured Chemistry | Test Bar #1 | Test Bar #2 | Test Bar #3 | Test Bar #4 |
|---|---|---|---|---|
| C | 0.34 | 0.34 | 0.35 | 0.36 |
| Mn | 0.52 | 0.57 | 0.54 | 0.54 |
| Cr | 1.04 | 1.05 | 1.04 | 1.04 |
| Al | 0.056 | 0.18 | 0.072 | 0.18 |
| V | — | — | 0.046 | 0.048 |
| Si | 0.33 | 0.34 | 0.32 | 0.32 |
| Mo* | 0.01 | 0.01 | 0.01 | 0.01 |
| Cu* | 0.02 | 0.02 | 0.02 | 0.02 |
| Ni* | 0.03 | 0.03 | 0.03 | 0.03 |

| Hardness - Rc** Distance From Quenched End 1/16 Inch | mm | | | | |
|---|---|---|---|---|---|
| 2 | 3.2 | 54½ | 53 | 52¼ | 53 |
| 4 | 6.4 | 50 | 52 | 48 | 52¼ |
| 6 | 9.5 | 42½ | 50½ | 41 | 50¾ |
| 8 | 12.7 | 36½ | 48 | 36 | 46¾ |
| 10 | 15.9 | 33 | 42¾ | 33 | 43¾ |
| 12 | 19.0 | 31¼ | 40¼ | 30½ | 40½ |
| 14 | 22.2 | 30 | 35¾ | 29¾ | 38 |
| 16 | 25.4 | 29¾ | 33½ | 29 | 35¾ |
| 18 | 28.6 | 28¼ | 32¼ | 28¾ | 34½ |
| 20 | 31.8 | 25¾ | 31½ | 28¾ | 32¼ |
| 22 | 34.9 | 23¼ | 31¼ | 27½ | 31¾ |
| 24 | 38.1 | 22 | 31¼ | 26 | 31½ |
| 26 | 41.3 | 21 | 27¾ | 24¼ | 32¼ |
| 28 | 44.4 | — | 25¼ | 22¼ | 31 |
| 30 | 47.6 | — | 23¼ | 20½ | 31 |
| 32 | 50.8 | — | 22¼ | — | 31½ |

*Mo, Cu and Ni were measured to assure that they were within allowable incidental amounts.
**Two Jominy traverses were taken on opposite sides of the test bar and averaged.

The graphical presentation of the above data in FIG. 1 illustrates the improved hardenability characteristics of test samples 2 and 4, having 0.18% aluminum over test samples 1 and 3 which respectively contain only 0.056% and 0.072% aluminum. While it is recognized that aluminum in amounts less than that present in test samples 2 and 4 may contribute somewhat to hardenability, it has been found that the influence of aluminum in amounts less than about 0.07% is inconsistent. Since aluminum readily combines with oxygen and nitrogen, the amount of aluminum available for hardening will depend on melt practices which influence the amount of free oxygen and nitrogen in the steel. For these reasons, 0.07% is considered to be the practical lower limit for consistent hardenability.

EXAMPLE 2

After heating and oil quenching, test bars for nitriding from the four taps were tempered. The nitriding grade alloy steel of the present invention can be tempered at relatively high temperatures without adversely reducing core hardness. Each of the four tests bars, having the composition as identified in Table I above, were heated to a temperature of 593° C. (1100° F.) and held at that temperature for three hours.

Figure 2:
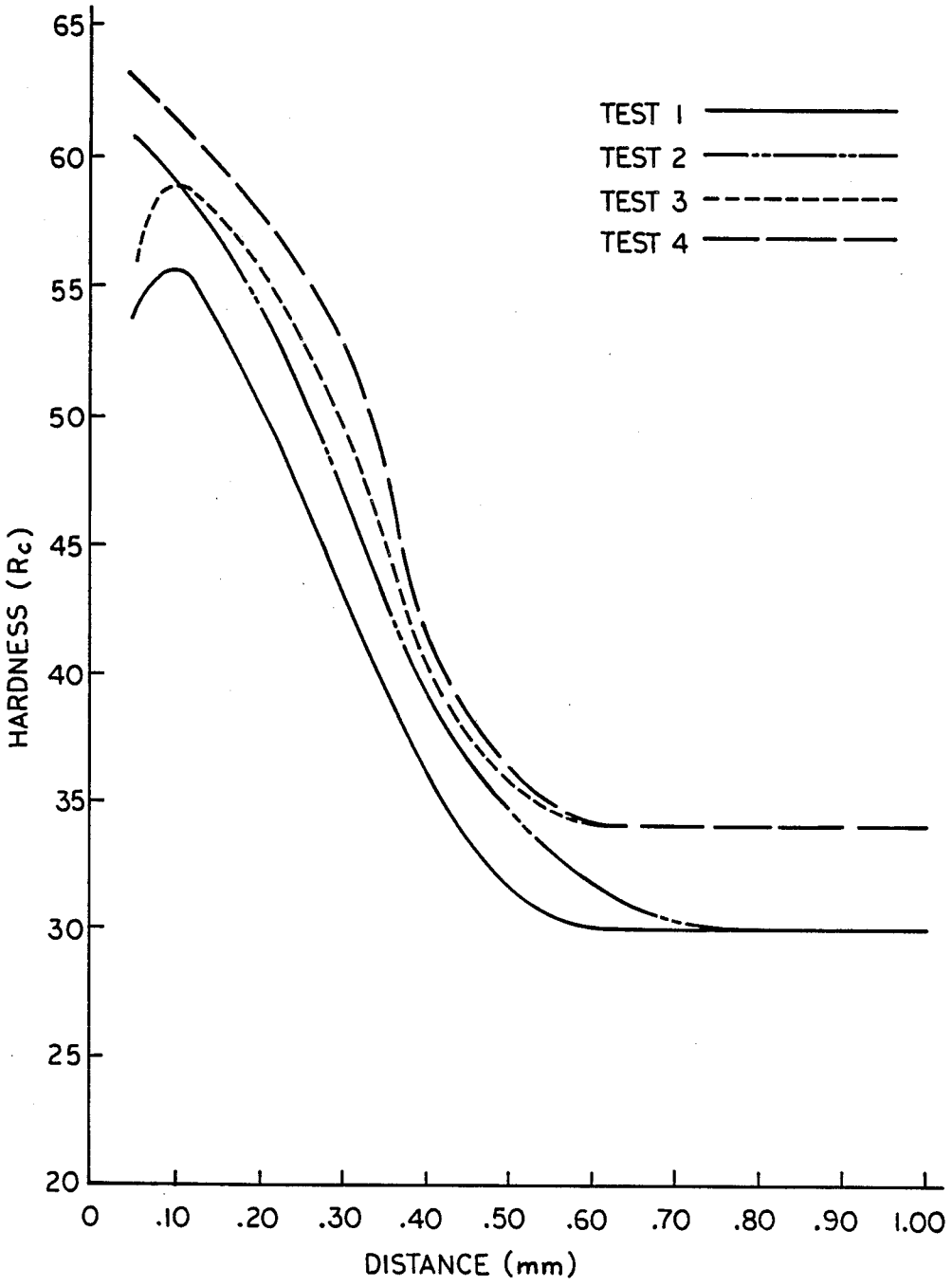
FIG. 2 is a graph illustrating the improved nitride response and resistance to loss of hardness during tempering of the alloy steel; and, FIG. 3 is a graph comparing the nitriding response of the alloy steel according to the present invention with a typical nitriding grade alloy steel.

After tempering, samples from the test bars were nitrided in an ammonia atmosphere at a temperature of about 526° C. (980° F.) for 28 hours. The hardness measurements, taken after nitriding the samples of the four taps corresponding respectively to test bars 1–4 described above in Table I, are shown below in Table II and illustrated graphically in FIG. 2. The hardness measurements were determined by taking a Tukon microhardness traverse of the nitrided sample and converting the Knoop hardness measurements to equivalent values on the Rockwell C Scale.

TABLE II

| Distance From Nitrided Surface (mm) | Hardness (Rc - Converted from Knoop) Test Sample 1 | Test Sample 2 | Test Sample 3 | Test Sample 4 |
|---|---|---|---|---|
| 0.05 | 54 | 61 | 56 | 63 |
| 0.10 | 56 | 59 | 59 | 62 |
| 0.15 | 52 | 57 | 57 | 59 |
| 0.20 | 50 | 54 | 56 | 58 |
| 0.25 | 47 | 49 | 53 | 56 |
| 0.30 | 43.5 | 47 | 50 | 53 |
| 0.40 | 36 | 39 | 40 | 40.5 |
| 0.50 | 32 | 35 | 36 | 37 |
| 0.60 | 30 | 32 | 34 | 34 |
| 0.75 | 30 | 30 | 32 | 32 |
| 1.00 | 30 | 30 | 32 | 32 |

This example illustrates the contribution of aluminum, and especially the unexpected benefit of the combination of aluminum and vanadium to hardness, both at the surface and in the core. Test sample 2, containing 0.18% aluminum and no vanadium, shows much higher surface hardness (3 to 7 points Rc) and substantially the same core hardness as test sample 1 which likewise contains no vanadium and has a lower aluminum content (0.056%). Both of the test samples containing about 0.05% vanadium, tests samples 3 and 4, have higher hardness than corresponding samples 1 and 2 which respectively have essentially the same base composition and aluminum addition but contain no vanadium. The highest hardness was measured on test sample 4 which contained 0.18% aluminum and 0.048% vanadium. The lowest hardness was measured on test sample 1 which had no vanadium and the lowest aluminum content, 0.056%.

Additional samples having compositions corresponding to test samples 1–4 above were tempered at 538° C. (1000°), 649° C. (1200° F.) and 704° C. (1300° F.). The same results were observed as those in the above sample which was tempered at 593° C. (1100° F.). In each case, sample 4 containing 0.18% aluminum and about 0.05% vanadium had higher surface hardness, and at least as high core hardness, than samples 1–3 which contained lower amounts of aluminum or vanadium.

EXAMPLE 3

Three additional test samples were prepared to measure the response to nitriding. Nitriding response is measured by the amount of time that a test sample must be held at an elevated temperature in an atmosphere containing raw ammonia to develop a predetermined nitride case depth. The measured composition of the three test pieces and their respective physical properties are listed below in Table III. The first test piece was formed of AISI/SAE 4140 material. This material has been commercially used by applicant and is generally recognized as a desirable nitriding grade alloy steel in heat treated and tempered, nitrided article applications. The second test piece, identified in Table III as test sample 5, contains aluminum and vanadium in the preferred range of the present invention. The third test piece, test sample 6, is similar to sample 5 except that sample 6 has added aluminum to increase the aluminum content to near the maximum amount desired in the more broadly contemplated range of the present invention. Two sets of the three above-described test pieces were prepared. Both sets were heated, quenched, and tempered as previously described for the test samples in Table II. After tempering, one set of the test pieces was nitrided in an atmosphere of raw ammonia gas with a dissociated ammonia carrier gas at a temperature of 526° C. (980° F.) for a period of 21 hours. The second set of test pieces was similarly nitrided for a period of 48 hours. These time periods were selected to assure a minimum case depth of 0.20 mm and 0.30 mm respectively in the control AISI/SAE 4140 test piece. After nitriding, the two sets of three test pieces were removed from the nitriding furnace and nitrided depth was determined by a Tukon microhardness traverse on a metallographic section of each test piece. The measured composition and hardness values are listed below in Table III, and the respective case depths as a function of nitriding time is illustrated graphically in FIG. 3.

TABLE III

| Chemistry | AISI/SAE 4140 | Test Sample #5 | Test Sample #6 |
|---|---|---|---|
| C | 0.39 | 0.31 | 0.31 |
| Mn | 0.71 | 1.12 | 1.13 |
| Cr | 0.98 | 0.93 | 0.94 |
| Al | 0.025 | 0.152 | 0.260 |
| V | — | 0.06 | 0.06 |
| Si | 0.25 | 0.35 | 0.36 |
| S | 0.012 | 0.010 | 0.010 |
| P | 0.022 | 0.025 | 0.025 |
| Mo | 0.14 | 0.03* | 0.03* |
| Cu | 0.01* | 0.12* | 0.12* |
| Ni | 0.06* | 0.09* | 0.09* |
| 21 HOUR NITRIDING TIME | | | |
| SURFACE HARDNESS Rockwell 15-N | 86 | 91 | 92 |
| CORE HARDNESS** Rockwell C | 28 | 28 | 28 |
| CASE DEPTH*** mm | 0.27 | 0.33 | 0.35 |
| 48 HOUR NITRIDING TIME | | | |
| SURFACE HARDNESS Rockwell 15-N | 87 | 90 | 92 |
| CORE HARDNESS** Rockwell C | 28 | 27 | 28 |
| CASE DEPTH*** mm | 0.38 | 0.47 | 0.50 |

*allowable residual amounts; these elements were not present as the result of controlled, planned or intentional additions.
**core hardness was measured as a Vickers Hardness number (DPH) and converted to a corresponding value on the Rockwell C scale.
***case depth is defined as the distance from the surface at which a Vickers hardness of 423 was measured.

Figure 3:
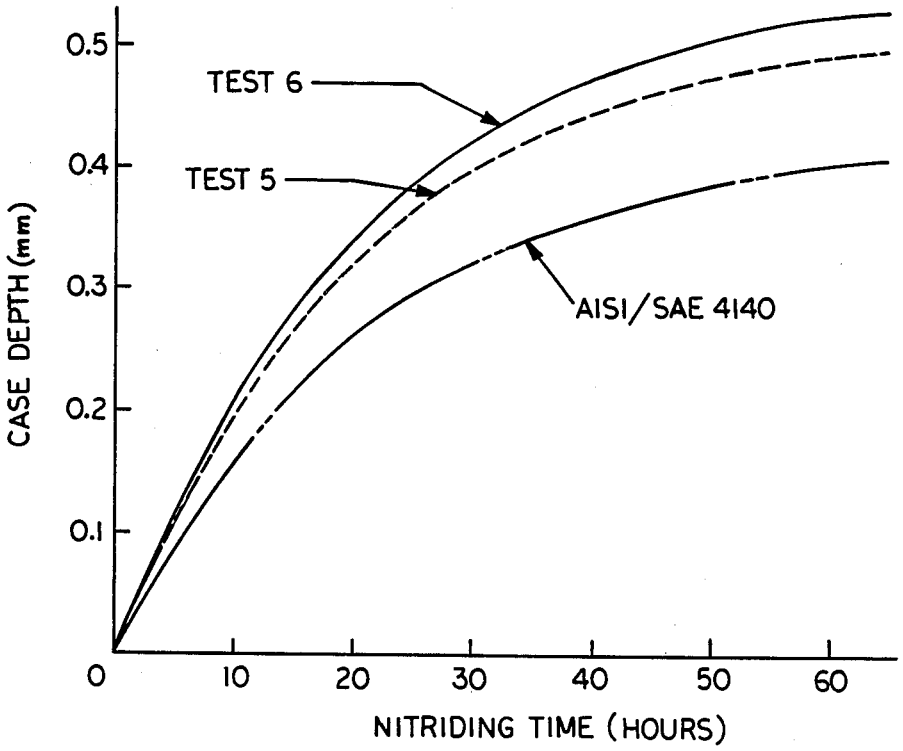

From the graph shown in FIG. 3, it can be seen that the 0.27 mm case depth of the prior art AISI/SAE 4140 material after 21 hours nitriding time can be realized in about 15 hours with the composition of the present invention. Similarly, a 0.38 mm case depth in the new material, having the preferred range of aluminum, can be reached in only about 25 hours whereas the prior art material required 48 hours. Thus it can be seen that nitriding time can be significantly reduced for articles having the composition of the present invention. For a case depth of 0.3 mm the nitriding time can be reduced on the order of 40% thereby effecting significant cost savings.

INDUSTRIAL APPLICABILITY

The present invention is particularly useful in the manufacture of oil or water quenched and tempered, nitrided articles such as gears, shafts, bushings and similar parts where maximum nitriding response is desired. Further, the alloy steel composition of the present invention is economical to produce in that it does not require expensive alloy additions. Still further, the new alloy steel is especially desirable in applications where nitrided articles are first hardened and then subsequently tempered and machined to final dimensions prior to nitriding. When applied in such instances, the new alloy steel provides a unique combination of hardenability, toughness, retention of high core hardness after tempering, and additional processing cost savings as a result of the material's excellent nitriding response.

Other aspects, objects and advantages of this invention can be obtained from a study of the drawings, the disclosure and appended claims.

I claim:

1. A nitrided steel article formed of a through hardening, nitriding grade steel having a composition consisting essentially of, by weight percent:

| | |
|---|---|
| Carbon | 0.24–0.34 |
| Manganese | 0.90–1.30 |
| Chromium | 0.90–1.20 |
| Aluminum | 0.07–0.20 |
| Vanadium | 0.05–0.10 |
| Iron and Trace Elements which include Molybdenum, Copper and Nickel | Balance |

and said article having a substantially uniform martensitic microstructure, a surface hardness of at least Rockwell 15N 89, and a core hardness of at least Rockwell C 25.

2. A nitrided steel article, as set forth in claim 1, wherein said article has been heated at a temperature of about 870° C. (1600° F.) for one hour, quenched, tempered at a temperature of about 593° C. (1100° F.) for one hour, and nitrided for about 15 hours at a temperature of about 526° C. (980° F.).

* * * * *